US009278038B2

(12) United States Patent
Masucci et al.

(10) Patent No.: US 9,278,038 B2
(45) Date of Patent: Mar. 8, 2016

(54) SUPPORTING AND MANEUVERABLE SLING FOR BED-CONSTRAINED PATIENTS

(71) Applicants: Mary Masucci, Staten Island, NY (US); Mark M. Santo, Staten Island, NY (US); Adele M. Pescitelli, Staten Island, NY (US)

(72) Inventors: Mary Masucci, Staten Island, NY (US); Mark M. Santo, Staten Island, NY (US); Adele M. Pescitelli, Staten Island, NY (US)

( * ) Notice: Subject to any disclaimer, the term of this patent is extended or adjusted under 35 U.S.C. 154(b) by 262 days.

(21) Appl. No.: 14/012,053

(22) Filed: Aug. 28, 2013

(65) Prior Publication Data

US 2015/0059767 A1 Mar. 5, 2015

(51) Int. Cl.
*A61G 7/00* (2006.01)
*A61G 7/10* (2006.01)

(52) U.S. Cl.
CPC ..... *A61G 7/001* (2013.01); *A61G 7/1023* (2013.01)

(58) Field of Classification Search
CPC ..... A61G 7/001
USPC ..... 128/874, 875, 869, 870, 745; 602/19
See application file for complete search history.

(56) References Cited

U.S. PATENT DOCUMENTS

| | | | | |
|---|---|---|---|---|
| 2,212,746 | A * | 8/1940 | Nunn | 119/770 |
| 4,196,723 | A * | 4/1980 | Moose, Jr. | 128/854 |
| 5,893,183 | A * | 4/1999 | Bechtold, Jr. | 5/632 |
| 6,508,389 | B1 * | 1/2003 | Ripoyla et al. | 224/157 |
| 2006/0137693 | A1 * | 6/2006 | Lewis et al. | 128/849 |
| 2010/0174250 | A1 * | 7/2010 | Hu et al. | 604/319 |

* cited by examiner

*Primary Examiner* — Victoria J Hicks
*Assistant Examiner* — Tarla Patel

(57) ABSTRACT

A flexible sheet with suspenders is used to safely handle and reposition bed-constrained patients. The suspenders include couplers and are used to secure either side of the flexible sheet to the side railing on a hospital bed. By wrapping the suspenders on one side of the flexible sheet over a patient and connecting them to the opposite side rail, a patient can be switched from a supine position to a turned position. A upper access hole and lower access gap in the flexible sheet then allow attendants to access the patients backside, where treatments can be applied. A flap is otherwise used to cover the upper access hole, being secured to the flexible sheet by a fold and a perimeter of hook-and-loop fasteners. The flexible sheet provides a safe patient handling method that will result in a decrease of workplace injuries.

18 Claims, 6 Drawing Sheets

SUPPORTING AND MANEUVERABLE SLING FOR BED-CONSTRAINED PATIENTS

FIELD OF THE INVENTION

The present invention relates generally to a sling for holding hospital patients in a turned position.

BACKGROUND OF THE INVENTION

In the course of treatment hospitals deal with many patients who are confined to their beds, for a multitude of reasons. Caring for said patients comes with a number of difficulties. Whether treating decubitus ulcers (bedsores), providing skin care, or simply changing the bedding, a patient's lack of mobility can make common tasks much more challenging. The difficulties of caring for bedridden patients increase when considering the prevalence of obesity. Something as simple as turning a person becomes taxing when working with bariatric patients. Bariatric care has become an ergonomic problem for health care providers, with many employees suffering back and neck injuries. This incurs extra costs for health care providers and insurance providers, as not only must workman's compensation be paid, but a replacement employee must also be brought in. In order to reduce the difficulty of dealing with bedridden patients, many inventions have been made to aid health care providers.

A common aid is a simple sling that is placed beneath a patient on their bed. The sling is used to help position a patient; a patient can be rolled on their left side or right side, after which the sling is wrapped around and secured to a stable surface, commonly the side rails of the bed. Such slings are beneficial as they hold a patient in place, allowing an attending health care worker to perform other tasks while the patient is turned. However, such slings have room for improvement. Since the sling wraps around the patient providing direct care is more difficult. For example, washing sores and applying creams is complicated by the sling, which often covers or prevents access to sores or other skin areas needing treatment. There exists a need for a patient handling device that allows a health care attendant to directly treat a patient.

It is therefore an object of the present invention to provide a patient sling that can restrain a bedridden patient in a given position. It is a further object of the present invention to provide a patient sling that reduces opportunities for a health care attendant to suffer injury while caring for a patient. It is a further object of the present invention to allow a health care attendant to access and treat a patient while the patient is held in a turned position by the sling. It is a functional object of the present invention to allow a health care attendant to administer skin care, such as applying dressings and treating bedsores, through openings and gaps provided as part of the present invention.

DETAIL DESCRIPTIONS OF THE INVENTION

All illustrations of the drawings are for the purpose of describing selected versions of the present invention and are not intended to limit the scope of the present invention.

Figure 1:
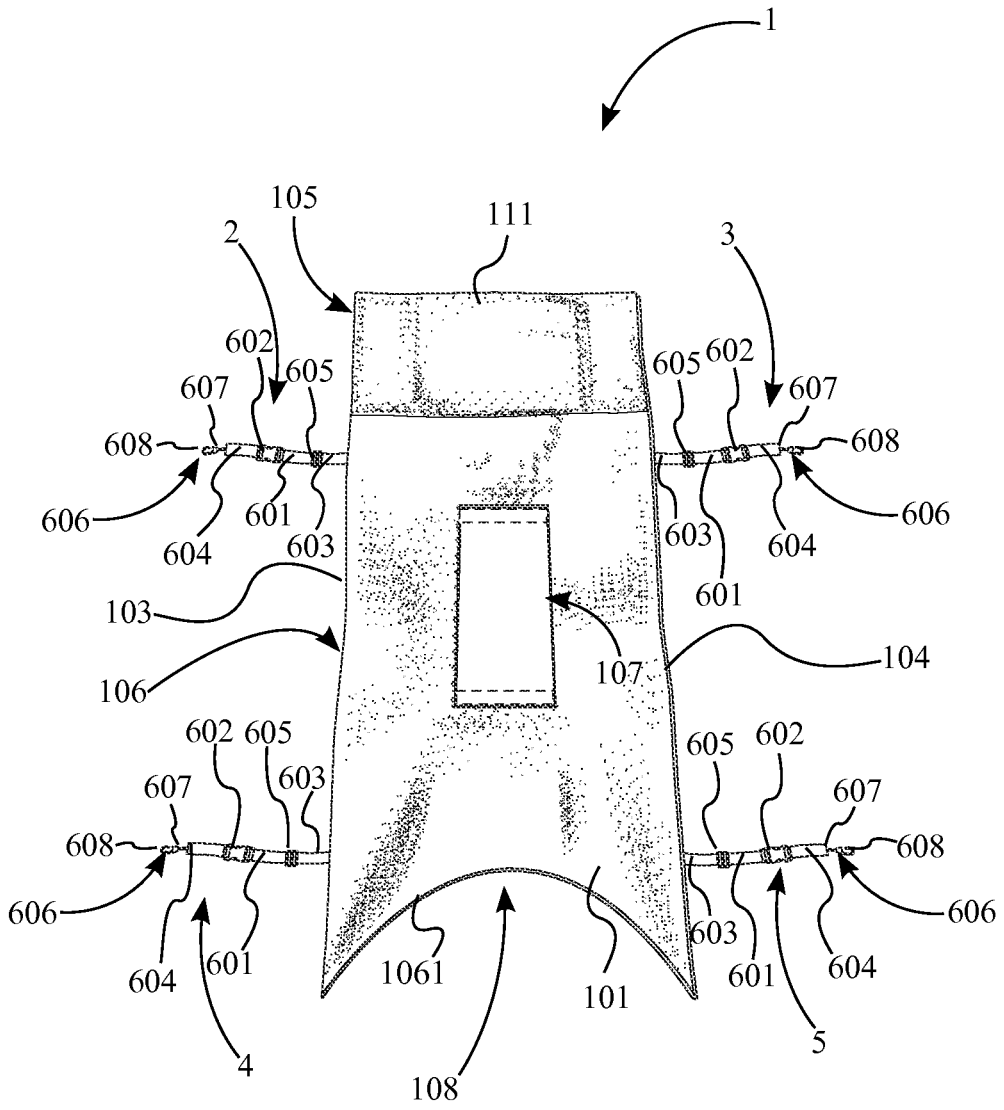
FIG. 1 is a top perspective view of the present invention.
Figure 2:
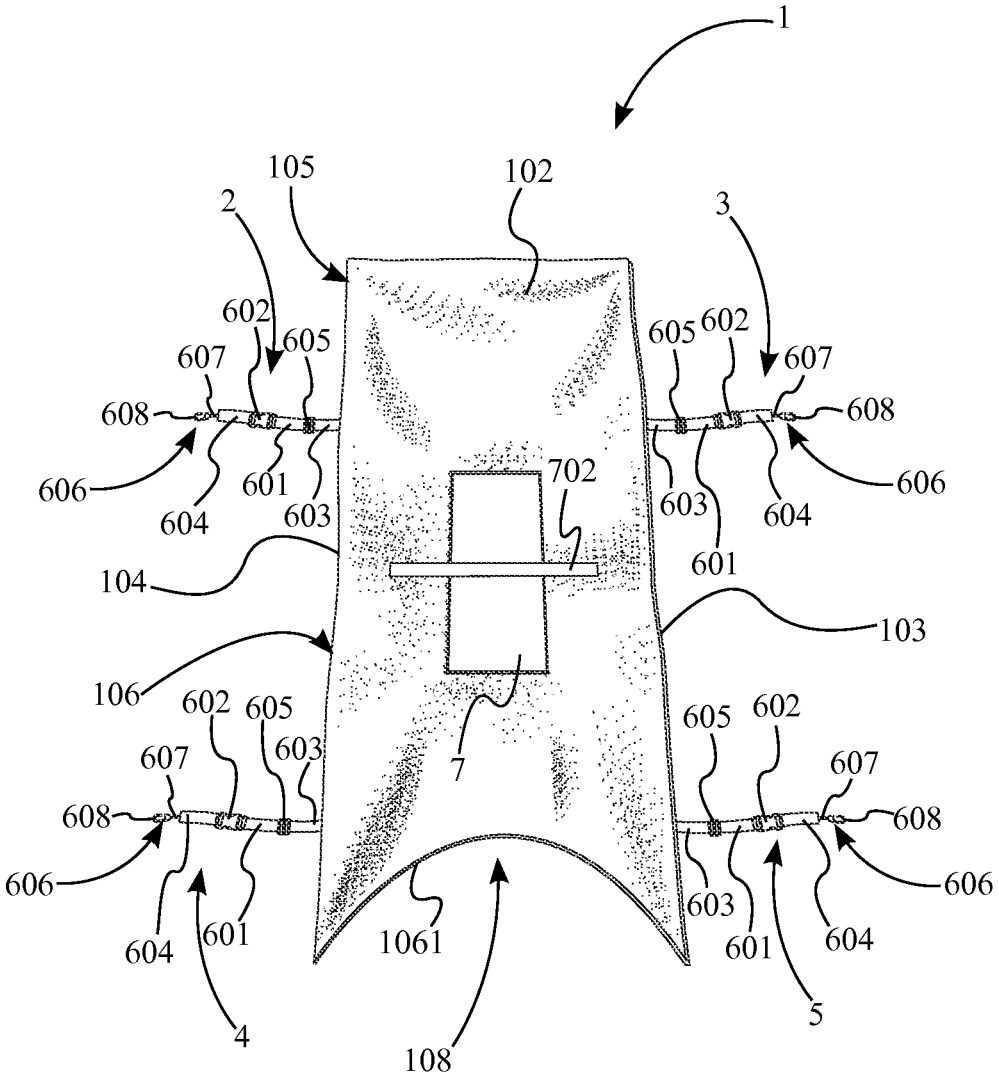
FIG. 2 is a bottom perspective view showing a closed flap of the present invention.
Figure 3:
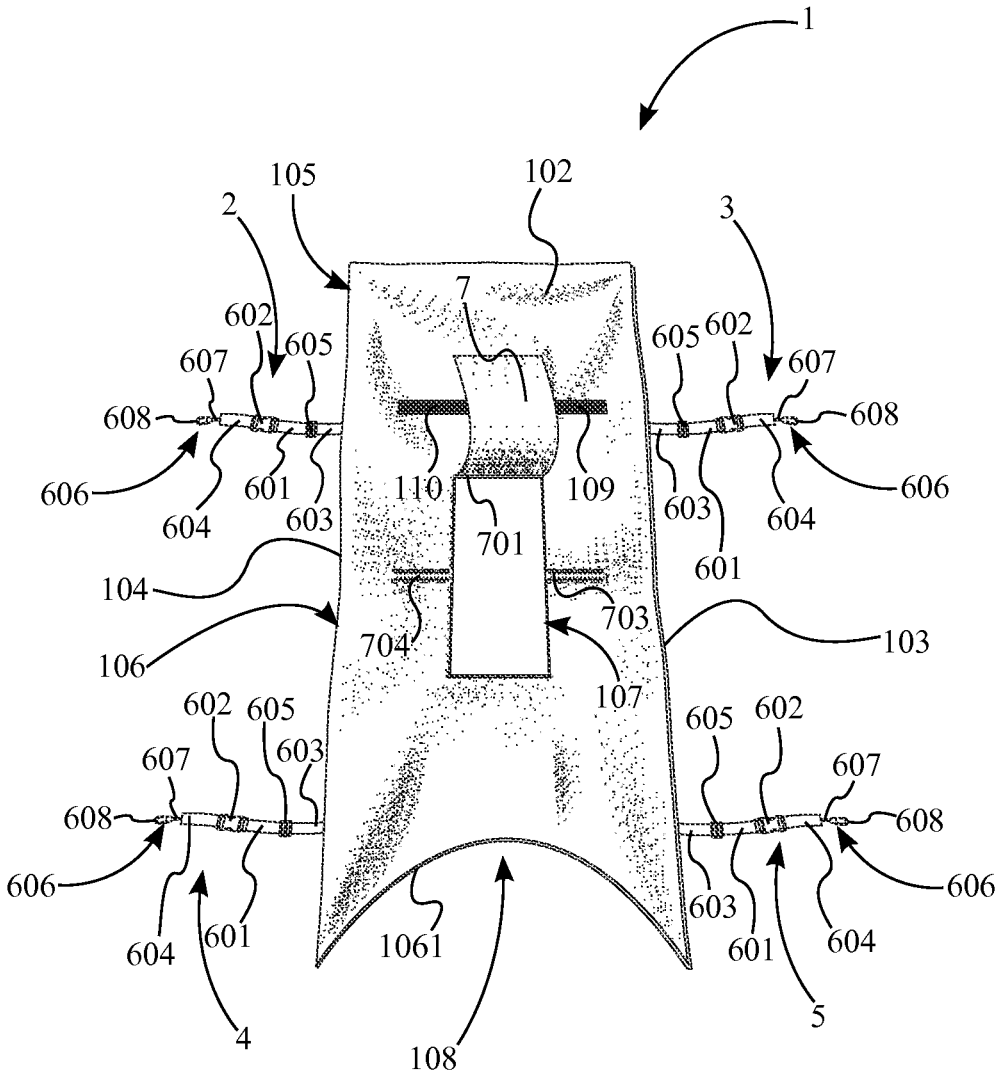
FIG. 3 is a bottom perspective view showing an open flap of the present invention.

The present invention is a sling designed to support bed-restrained patients, aiding health care workers in maneuvering and treated said patients. The present invention comprises a flexible sheet 1, a first suspender 2, a second suspender 3, a third suspender 4, a fourth suspender 5, and a flap 7, as can be seen in FIG. 1, FIG. 2, and FIG. 3. The present invention is designed to be used in conjunction with hospital bedding or a hospital bed 10. The flexible sheet 1 is placed atop a mattress, with the first suspender 2, second suspender 3, third suspender 4, and fourth suspender 5 sticking out from either side of the flexible sheet 1. The flap 7 is incorporated into the flexible sheet 1 and is intended to provide access to a patient without removing said patient from the sling. The suspenders are designed to wrap around a patient and secure to the edge of a hospital bedding, holding a patient in a turned position allowing health care workers to easily and safely treat the patient's backside.

The flexible sheet 1, as illustrated in FIG. 1, FIG. 2, and FIG. 3, comprises a top face 101, a bottom face 102, a first edge 103, a second edge 104, an upper body section 105, a lower body section 106, an upper access hole 107, and a lower access gap 108. The top face 101 and the bottom face 102 form flat surfaces for the flexible sheet 1, with the top face 101 and bottom face 102 being opposite surfaces of the flexible sheet 1. When the flexible sheet 1 is placed on bedding, such as in FIG. 4, the bottom face 102 faces downwards, towards a mattress or other similar element. The top face 101 faces upwards and serves as the surface upon which a patient rests. The first edge 103 and the second edge 104 are part of the perimeter of the flexible sheet 1, forming opposite sides of the flexible sheet 1. The lower body section 106 comprises a concave edge 1061, which forms a bottom edge of the flexible sheet 1. The concave edge 1061 forms part of the perimeter of the flexible sheet 1, in combination with the first edge 103 and the second edge 104, which are connected to either side of the concave edge 1061. The concave edge 1061 curves inwards towards the flexible sheet 1. In the preferred embodiment, where the flexible sheet 1 is of a rectangular shape, the first edge 103 and the second edge 104 are the long edges of the rectangle. The flexible sheet 1 is split into two sections, the upper body section 105 and the lower body section 106. Along the length of the flexible sheet 1, the upper body section 105 is located next to one end and the lower body section 106 is located next to the opposite end. The upper body section 105 and the lower body section 106 support different areas of the patient; when a patient is resting on the flexible sheet 1, their upper torso and head should be placed upon the upper body section 105, while the lower torso and sacrum should be placed upon the lower body section 106. A upper access hole 107 is cut from the flexible sheet 1 at the upper body section 105, allowing a patient's upper back area to be accessed through the flexible sheet 1. Likewise, a lower access gap 108 is cut from the flexible sheet 1 at the lower body section 106 and adjacent to the concave edge 1061, providing an attending health care worker with access to the patient's lower back and sacral region. Overall, these components provide a supportive surface for a patient while still allowing health care workers to treat normally hard to reach areas, such as the back and sacral region.

In the preferred embodiment the flexible sheet 1 is made to be water repellant, or potentially water proof, in the lower body section 106. This section of the flexible sheet 1 corresponds to and supports the sacral region of a patient when the present invention is in use. The upper access hole 107 is preferably oblong shaped, though in other embodiments it may be made elliptical or any other shape that still provides access to a patient's backside. The lower access gap 108 is preferably semicircular, as it is delineated by the concave edge 1061.

Connected to either the first edge 103 or the second edge 104 of the flexible sheet 1 are the first suspender 2, the second suspender 3, the third suspender 4, and the fourth suspender 5, all of which are visible in FIG. 1, FIG. 2, and FIG. 3. The four suspenders are identical to each other, with each suspender comprising a strap 601, a quick-release buckle 602, a first end 603, a second end 604, a strap adjuster 605, and a coupler 606. There are two ends for each suspender, which form opposite ends of the strap 601. The suspenders are connected to the flexible sheet 1 by the first end 603. At the second end 604, opposite the first end 603, each strap 601 has a coupler 606. Positioned on the strap 601, preferably within six inches of the coupler 606, is the quick-release buckle 602. Also positioned on the strap 601 is the strap adjuster 605, which allows a user to adjust the length of the strap 601, useful when using the present invention with non-standard sized beds.

In the preferred embodiment, the coupler 606 is a hook, like shown in FIG. 1, FIG. 2, and FIG. 3, that comprises a handle 607 and an arced section 608. The arced section 608 of the hook allows the suspenders to be secured to the side railing 9 of a hospital bed 10. The preferred embodiment also utilizes a quick-release buckle 602 that comprises a male portion and a female portion, which can quickly and easily be detached from each other by squeezing the male portion to remove it from the female portion. This type of buckle is also known as a side release buckle. The strap adjuster 605, a common accessory, has two gaps and a center brace. A loose strap 601 portion can be threaded through the strap adjuster 605; this allows a user to move the strap adjuster 605 in order to lengthen or shorten the strap 601. In other embodiments the coupler 606 could have an additional locking mechanism, such as a clip hook (as in a carabiner) or a trigger hook (often seen in key rings). Providing a locking mechanism will offer increased stability for the present invention, which otherwise relies on tension in the couplers 606 to secure the suspenders to the railing 9.

The first suspender 2, the second suspender 3, the third suspender 4, and the fourth suspender 5 are connected to the flexible sheet 1 by their respective first ends 603. The first suspender 2 and the third suspender 4 are positioned next to the first edge 103; the second suspender 3 and the fourth suspender 5 are positioned next to the second edge 104, mirroring the first suspender 2 and the third suspender 4. The first suspender 2 and the third suspender 4 are opposite each other, lengthwise, along the flexible sheet 1. As a result, the first suspender 2 is located adjacent to the upper body section 105 at the first edge 103 while the third suspender 4 is located adjacent to the lower body section 106 at the first edge 103. Likewise, the second suspender 3 is located adjacent to the upper body section 105 at the second edge 104 while the fourth suspender 5 is located adjacent to the lower body section 106 at the second edge 104.

In the preferred embodiment the suspenders are positioned such that the first suspender 2 and the second suspender 3 are coplanar with each other. Similarly, the third suspender 4 and fourth suspender 5 are coplanar with each other. Though the preferred embodiment describes a total of four suspenders, other embodiment may choose to employ a greater number of suspenders. Increasing the number of suspenders may increase the support offered by the sling, but additional suspenders comes with a corresponding increase in costs and time needed to secure or release the suspenders from the hospital bed 10. To reduce costs it is also possible to utilize a single suspender with each long edge, for a total of two suspenders, but this comes with a decrease in structural support for the sling. Two suspenders may not be sufficient to support a patient, especially with the obese and bariatric patients that have become increasingly common in the hospital setting. The straps 601 themselves are preferably of nylon construction.

In addition to the suspenders, a flap 7 is connected to the bottom face 102 of the flexible sheet 1. The flap 7, which comprises a fold 701, is positioned in the upper body section 105 adjacent to the upper access hole 107. The flap 7 is used to cover the upper access hole 107 when a patient is lying on their back. When a patient is rotated to their side and held in that position by the sling, the flap 7 can be pulled away from the upper access hole 107, allowing a health care worker access to a patient's backside. The fold 701 connects the flap 7 to the bottom face 102. The various positions of the flap 7 can be seen in FIG. 1, FIG. 2, FIG. 3, FIG. 4, FIG. 5, and FIG. 6.

In the preferred embodiment the flap 7 is oblong in shape and sized to match the upper access hole 107. This allows the flap 7 to cover the upper access hole 107 when the patient's backside does not need to be accessed. The fold 701 connects a single edge, preferably one of the two short edges, of the flap 7 to the bottom face 102. In other embodiments where a non-oblong shape is used for the upper access hole 107, the flap 7 will be similarly shaped. For example, if the upper access hole 107 is elliptical, then the flap 7 will also be elliptical in shape.

Other accessory components of the present invention are a elevated cushioned cradle 111, visible in FIG. 1, and a flap attachment system, visible in FIG. 3, which in the preferred embodiment is a hooks-and-loops attachment. As part of these accessory components the flexible sheet 1 further comprises a first loops portion 109, a second loops portion 110, and the elevated cushioned cradle 111; the flap 7 further comprises a fastening strap 702, a first hooks portion 703, and a second hooks portion 704. The elevated cushioned cradle 111 is positioned in a top area of the flexible sheet 1 to support a patient's head. The first loops portion 109 is positioned adjacent to the upper access hole 107. Similarly, the second loops portion 110 is positioned adjacent to the upper access hole 107, but opposite the first loops portion 109 across the upper access hole 107. The first hooks portion 703 and the second hooks portion 704 are positioned opposite each other along the fastening strap 702. The fastening strap 702 itself is connected across the backside of the flap 7, positioned opposite the top face 101 of the flexible sheet 1.

The elevated cushioned cradle 111 is connected to the upper body section 105 on the top face 101, serving as an integrated pillow for a patient. The elevated cushioned cradle 111 is positioned above the upper access hole 107, where a patient's head would rest. The elevated cushioned cradle 111 is designed such that a patient's head will be at a higher elevation than the rest of their body, when in a supine position. The shape, material, and filling of the elevated cushioned cradle 111 can vary as long as it provides a soft, supportive, and ergonomic area for a patient's head. Preferably, the material of the elevated cushioned cradle 111 will seal the filling from fluid spills, as well as be tolerable of the sanitizing chemicals that are used to clean the present invention.

The first loops portion 109 and the second loops portion 110 are positioned on the bottom face 102 adjacent to the upper access hole 107. The second loops portion 110 is positioned opposite the first loops portion 109 across the upper access hole 107, such that a loops portion is placed on each side of the upper access hole 107. The first loops portion 109 and second loops portion 110 are positioned to receive their respective aligned first hooks portion 703 and second hooks portion 704, which are positioned on the fastening strap 702. That is, the placement of the first loops portion 109 and the first hooks portion 703 is such that they align with each other, causing the first loops portion 109 to engage with the first hooks portion 703. In the same manner, the placement of the second loops portion 110 and second hooks portion 704 is such that they align with each other, resulting in the second loops portion 110 engaging with the second hooks portion 704. In this manner, the flap 7 is attached to the bottom face 102. By engaging each loops portion with its respective hooks portion, the flap 7 is completely secured to the flexible sheet 1. This gives the appearance that the flexible sheet 1 appears to be a single uninterrupted surface, e.g. the upper access hole 107 is covered by the flap 7. If a patient needs to be accessed through the upper access hole 107, the hook-and-loop attachment method allows a health care provider to simply fold back the flap 7, disengaging each loops portion from its respective hooks portion.

The preferred embodiment uses a hook-and-loop method to completely secure the flap 7 to the bottom face 102. In other embodiments it is possible to use a variety of other attachment methods. For example, zipper teeth could be included along the upper access hole 107 and flap 7. A slider could be used to zip or unzip the flap 7 from the bottom face 102. This provides the same functionality as the hook-and-loop method, although the hook-and-loop method has advantages that make it the preferred method. While a zipper method can provide the same functionality, the teeth can prove uncomfortable for a patient, who will be resting with their backside on said teeth when in a standard supine position. A hook-and-loop material is much more comfortable for a patient to rest on. In addition, a hook-and-loop material is sanitary and washable, allowing the present invention to be provided as a reusable apparatus, rather than only being disposable. If other attachment methods are employed they should take into account the above criteria, being comfortable for the patient and easily sanitized by a health care provider.

Figure 4:
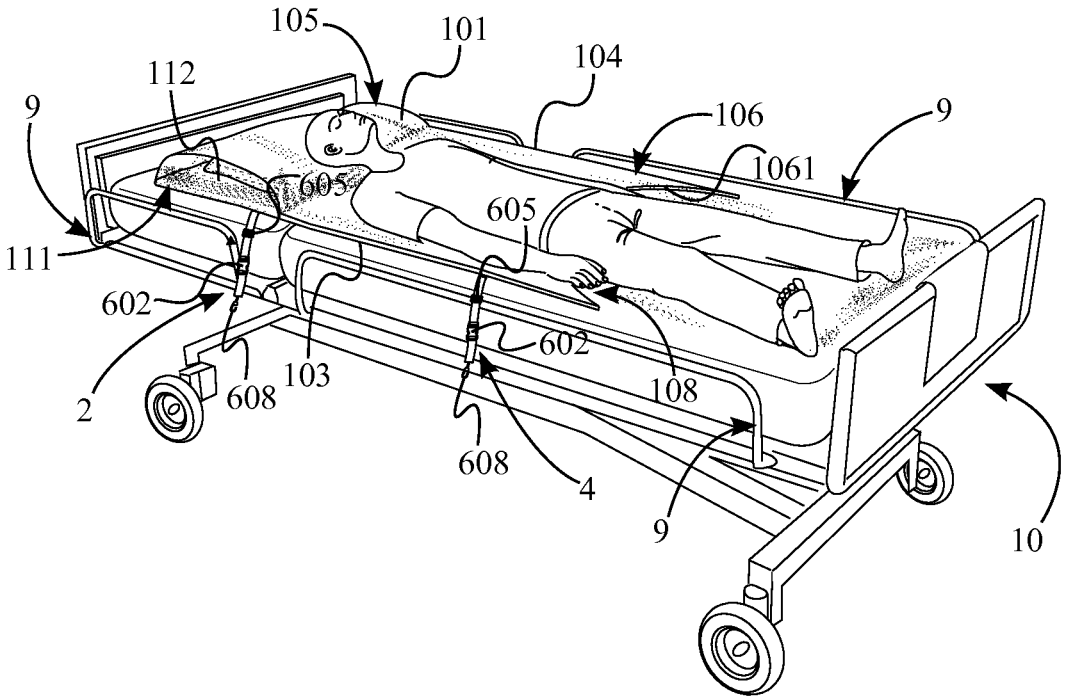
FIG. 4 is a perspective view showing the present invention in use, with a patient resting in a supine position on the present invention.

To use the present invention, the flexible sheet 1 is placed on a bed, with the bottom face 102 down and the top face 101 up, as depicted in FIG. 4. The flexible sheet 1 should be oriented so that the first suspender 2 and third suspender 4 are on one long side of the bed, with the second suspender 3 and fourth suspender 5 being on the opposite long side of the bed. A patient can then be laid on the top face 101 of the flexible sheet 1, with the patient's head resting on the elevated cushioned cradle 111, their upper torso being over the upper access hole 107, and their sacral region being aligned with the lower access gap 108. The flexible sheet 1 effectively serves as a resting surface for the patient, and can be left in place for the length of a day.

Figure 5:
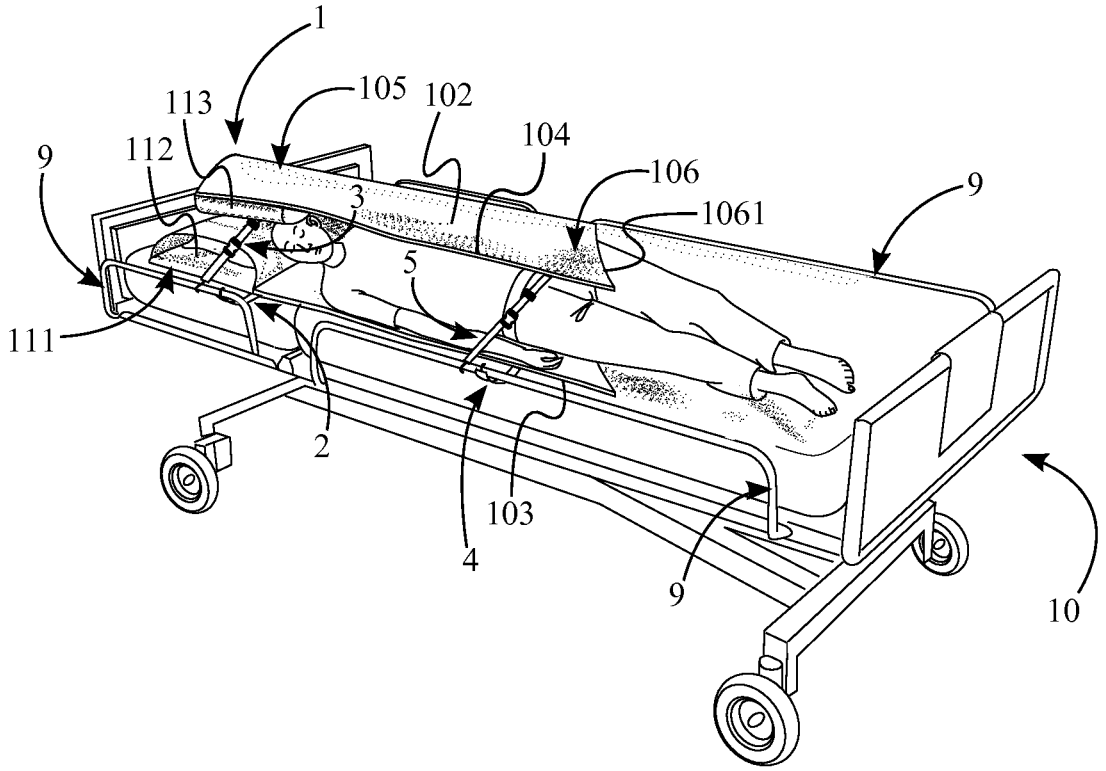
FIG. 5 is a perspective view showing a patient rolled to their right side and held in place by the present invention.
Figure 6:
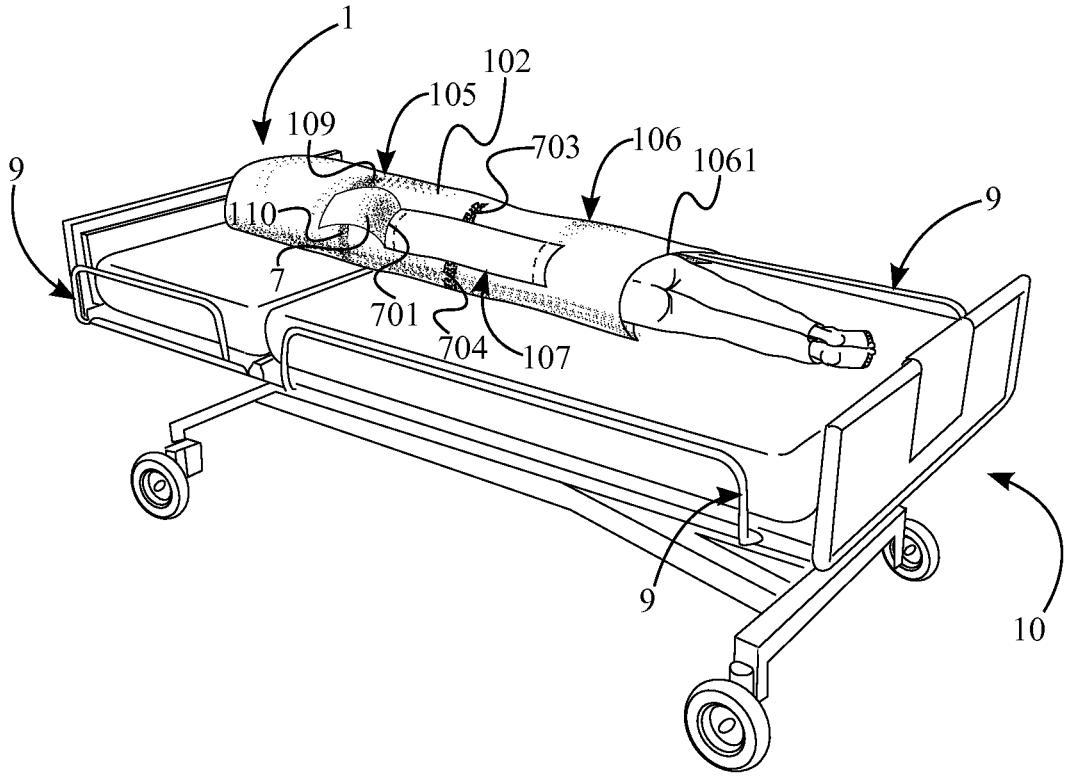
FIG. 6 is a perspective view showing a patient rolled to their left side and held in place by the present invention, with the flap being pulled back and allowing access to the patient's backside.

The present invention allows a health care provider to easily attend to the patient, rotating the patient to help prevent the formation of bed sores, as well as accessing the patient's backside to apply creams and other treatments to pre-existing bed sores. To rotate a patient such that they are resting on their right side, the following actions must be taken. First, the first suspender 2 and the third suspender 4 must pulled underneath the adjacent railing 9, allowing their respective couplers 606 to grasp on and attach to the railing 9 on that side of the bed. This secures part of the flexible sheet 1 in place. Next, the second suspender 3 and the fourth suspender 5 are pulled across the patient and threaded over the railing 9 on the patient's right side. After being pulled over the railing 9 the couplers 606 of the second suspender 3 and the third suspender 4 are secured to the railing 9, just as the couplers 606 on the first suspender 2 and third suspender 4 secure to the railing 9. This results in the flexible sheet 1 forming a sling that holds the patient, secured in place by the four suspenders. Similar steps are followed to turn a patient on their left side, except with the first suspender 2 and third suspender 4 wrapping around the patient rather than the second suspender 3 and fourth suspender 5. This alignment is illustrated in FIG. 5.

If a patient needs to quickly be returns to the supine position, the quick-release buckles 602 allow the couplers 606 to be quickly detached from the straps 601. This allows an attending health care worker to quickly reposition a patient, especially if the health care worker is on the opposite side of the bed 10 as the couplers 606; rather than having to quickly move to the opposite side of the bed 10 to release the couplers 606, the health care worker can quickly and easily disengage the quick-release buckles 602, allowing the patient to roll back into a supine position.

As a result, the patient is held in a turned position without the need for health care workers to physically support the patient; all the support is provided by the present invention. The elevated cushioned cradle 111 offers provides support to the patient's head and neck area so they are comfortable while in this turned position. This reduces the amount of workers required to attend to patients, especially bariatric patients who could otherwise require several attendants. With the present invention supporting a patient in a turned position, a health care worker can then easily access a patient's backside. Thanks to the hook-and-loop attachment, the flap 7 can easily be folded away from the upper access hole 107, allowing the patient's skin to be directly accessed and treated, like shown in FIG. 6. Tasks such as changing sheets on the bed, washing the back, applying creams, treating bed sores, changing dressings, and administering topical medication become much easier when both hands are available; without the present invention, one arm may be required to keep the patient turned and therefore be unavailable for other tasks.

The present invention is preferably constructed for single patient use. A variety of materials may be used for the construction of the present invention, though they should be comfortable for patients and tolerant of the various cleaning chemicals used in hospital environments. Ideally, a waterproof material will also be provided for the area in the lower body section 106 and around the lower access gap 108, or even the entire flexible sheet 1. The washable nature of the present invention will allow it to be cleaned, such that one unit will be useable for a single patient's stay at the hospital. While the present invention is preferably durable, long term use may require replacement, potentially in the three or four month time frame.

The functionality offered by the present invention provides numerous advantages in the workplace. Primarily, the present invention offers safe patient handling, resulting in a decrease in injuries resulting from moving, lifting, positioning, dressing changes, and changing patient's sheets. Effectively, the present invention serves to prevent employee injuries by providing a safe patient handling device.

Although the invention has been explained in relation to its preferred embodiment, it is to be understood that many other possible modifications and variations can be made without departing from the spirit and scope of the invention as hereinafter claimed.

What is claimed is:

1. A supporting and maneuverable sling for bed-constrained patients comprises:

a flexible sheet;

a first suspender;

a second suspender;

a third suspender;

a fourth suspender;

a flap;

the flexible sheet comprises a top face, a bottom face, a first edge, a second edge, an upper body section, a lower body section, an upper access hole, and a lower access gap;

the lower body section comprises a concave edge;

the first suspender, the second suspender, the third suspender, and the fourth suspender each comprise a strap, a quick-release buckle, a first end, a second end, a strap adjuster, and a coupler;

the flap comprises a fold;

the first suspender and the third suspender being positioned adjacent to the first edge;

the second suspender and the fourth suspender being positioned adjacent to the second edge;

the first edge and the second edge being positioned opposite each other across the flexible sheet;

an upper access hole traversing through the top face and the bottom face;

the lower access gap traversing through the top face and the bottom face;

the flap being positioned adjacent to the bottom face and the upper access hole;

the flexible sheet further comprises a first loops portion and a second loops portion;

the flap further comprises a fastening strap, a first hooks portion, and a second hooks portion;

the first loops portion and the second loops portion being positioned on the bottom face adjacent to the upper access hole;

the second loops portion being positioned opposite the first loops portion across the upper access hole;

the fastening strip being connected across the flap;

the fastening strap being positioned opposite the top face through the flexible sheet;

the first hooks portion and the second hooks portion being positioned opposite each other along the fastening strap;

the first hooks portion being engaged with the first loops portion; and the second hooks portion being engaged with the second loops portion.

2. The supporting and maneuverable sling for bed-constrained patients as claimed in claim 1 comprises:

the first end and the second end being positioned opposite each other along the strap;

the first end of the first suspender and the first end of the third suspender being connected to the first edge; and the first end of the second suspender and the first end of the fourth suspender being connected to the second edge.

3. The supporting and maneuverable sling for bed-constrained patients as claimed in claim 1 comprises:

the coupler comprises a handle and an arced section, wherein the arced section engages with a railing on a hospital bed;

the handle being connected to the second end; and the arced section being positioned opposite the second end along the coupler.

4. The supporting and maneuverable sling for bed-constrained patients as claimed in claim 1 comprises:

the quick-release buckle being positioned adjacent to the second end; and the strap adjuster being positioned between the first end and the second end.

5. The supporting and maneuverable sling for bed-constrained patients as claimed in claim 4 comprises:

the strap being slidably engaged with the strap adjuster.

6. The supporting and maneuverable sling for bed-constrained patients as claimed in claim 1 comprises:

the flap being connected to the bottom face by the fold;

the first edge being and the second edge being positioned opposite each other along the concave edge;

the first edge and the second edge being adjacently connected to the concave edge;

the top face being positioned adjacent to the bottom face through the flexible sheet;

the top face and the bottom face being positioned between the first edge and the second edge;

the upper body section and the lower body section being positioned adjacent to each other;

the upper access hole being positioned on the upper body section; and the lower access gap being positioned on the lower body section adjacent to the concave edge.

7. The supporting and maneuverable sling for bed-constrained patients as claimed in claim 6 comprises:

the upper access hole being oblong;

the lower access gap being semicircular; and the lower body section being water repellant.

8. The supporting and maneuverable sling for bed-constrained patients as claimed in claim 1 comprises:

the flexible sheet further comprises an elevated cushioned cradle;

the elevated cushioned cradle being connected to the upper body section on the top face; and the elevated cushioned cradle being positioned adjacent to the upper access hole opposite the lower access gap.

9. A supporting and maneuverable sling for bed-constrained patients comprises:

a flexible sheet;

a first suspender;

a second suspender;

a third suspender;

a fourth suspender;

a flap;

the flexible sheet comprises a top face, a bottom face, a first edge, a second edge, an upper body section, a lower body section, an upper access hole, and a lower access gap;

the lower body section comprises a concave edge;

the first suspender, the second suspender, the third suspender, and the fourth suspender each comprise a strap, a quick-release buckle, a first end, a second end, a strap adjuster, and a coupler;

the flap comprises a fold;

the first suspender and the third suspender being positioned adjacent to the first edge;

the second suspender and the fourth suspender being positioned adjacent to the second edge;

the first end of the first suspender and the first end of the third suspender being connected to the first edge;

the first end of the second suspender and the first end of the fourth suspender being connected to the second edge;

the first edge and the second edge being positioned opposite each other across the flexible sheet;

an upper access hole traversing through the top face and the bottom face;

the lower access gap traversing through the top face and the bottom face;

the flap being positioned adjacent to the bottom face and the upper access hole;

the upper access hole being positioned on the upper body section;

the lower access gap being positioned on the lower body section adjacent to the concave edge;

the flexible sheet further comprises a first loops portion and a second loops portion;

the flap further comprises a fastening strap, a first hooks portion, and a second hooks portion;

the first loops portion and the second loops portion being positioned on the bottom face adjacent to the upper access hole;

the second loops portion being positioned opposite the first loops portion across the upper access hole;

the fastening strap being connected across the flap;

the fastening strap being positioned opposite the top face through the flexible sheet;

the first hooks portion and the second hooks portion being positioned opposite each other along the fastening strap;

the first hooks portion being engaged with the first loops portion; and the second hooks portion being engaged with the second loops portion.

10. The supporting and maneuverable sling for bed-constrained patients as claimed in claim 9 comprises:

the first end and the second end being positioned opposite each other along the strap.

11. The supporting and maneuverable sling for bed-constrained patients as claimed in claim 9 comprises:

the coupler comprises a handle and an arced section, wherein the arced section engages with a railing on a hospital bed;

the handle being connected to the second end; and the arced section being positioned opposite the second end along the coupler.

12. The supporting and maneuverable sling for bed-constrained patients as claimed in claim 9 comprises:

the quick-release buckle being positioned adjacent to the second end;

the strap adjuster being positioned between the first end and the second end; and the strap being slidably engaged with the strap adjuster.

13. The supporting and maneuverable sling for bed-constrained patients as claimed in claim 9 comprises:

the flap being connected to the bottom face by the fold;

the first edge being and the second edge being positioned opposite each other along the concave edge;

the first edge and the second edge being adjacently connected to the concave edge;

the top face being positioned adjacent to the bottom face through the flexible sheet;

the top face and the bottom face being positioned between the first edge and the second edge;

the upper body section and the lower body section being positioned adjacent to each other;

the upper access hole being oblong;

the lower access gap being semicircular; and the lower body section being water repellant.

14. The supporting and maneuverable sling for bed-constrained patients as claimed in claim 9 comprises:

the flexible sheet further comprises an elevated cushioned cradle;

the elevated cushioned cradle being connected to the upper body section on the top face; and the elevated cushioned cradle being positioned adjacent to the upper access opposite the lower access gap.

15. A supporting and maneuverable sling for bed-constrained patients comprises:

a flexible sheet;

a first suspender;

a second suspender;

a third suspender;

a fourth suspender;

a flap;

the flexible sheet comprises a top face, a bottom face, a first edge, a second edge, an upper body section, a lower body section, an upper access hole, a lower access gap, a first loops portion, a second loops portion, and an elevated cushioned cradle;

the lower body section comprises a concave edge;

the first suspender, the second suspender, the third suspender, and the fourth suspender each comprise a strap, a quick-release buckle, a first end, a second end, a strap adjuster, and a coupler;

the flap comprises a fold, a fastening strip, a first hooks portion, and a second hooks portion;

the first suspender and the third suspender being positioned adjacent to the first edge;

the second suspender and the fourth suspender being positioned adjacent to the second edge;

the first end of the first suspender and the first end of the third suspender being connected to the first edge;

the first end of the second suspender and the first end of the fourth suspender being connected to the second edge;

the first edge and the second edge being positioned opposite each other across the flexible sheet;

an upper access hole traversing through the top face and the bottom face;

the lower access gap traversing through the top face and the bottom face;

the flap being positioned adjacent to the bottom face and the upper access hole;

the flap being connected to the bottom face by the fold;

the first edge being and the second edge being positioned opposite each other along the concave edge;

the first edge and the second edge being adjacently connected to the concave edge;

the upper body section and the lower body section being positioned adjacent to each other;

the upper access hole being positioned on the upper body section; and the lower access gap being positioned on the lower body section adjacent to the concave edge.

16. The supporting and maneuverable sling for bed-constrained patients as claimed in claim 15 comprises:

the first end and the second end being positioned opposite each other along the strap;

the coupler comprises a handle and an arced section, wherein the arced section engages with a railing on a hospital bed;

the handle being connected to the second end;

the arced section being positioned opposite the second end along the coupler;

the quick-release buckle being positioned adjacent to the second end;

the strap adjuster being positioned between the first end and the second end; and the strap being slidably engaged with the strap adjuster.

17. The supporting and maneuverable sling for bed-constrained patients as claimed in claim 15 comprises:

the top face being positioned adjacent to the bottom face through the flexible sheet;

the top face and the bottom face being positioned between the first edge and the second edge;

the upper access hole being oblong;

the lower access gap being semicircular; and the lower body section being water repellant.

18. The supporting and maneuverable sling for bed-constrained patients as claimed in claim 15 comprises:

the first loops portion and the second loops portion being positioned on the bottom face adjacent to the upper access hole;

the second loops portion being positioned opposite the first loops portion across the upper access hole;

the fastening strip being connected across the flap;

the fastening strap being positioned opposite the top face through the flexible sheet;

the first hooks portion and the second hooks portion being positioned opposite each other along the fastening strap;

the first hooks portion being engaged with the first loops portion;

the second hooks portion being engaged with the second loops portion;

the elevated cushioned cradle being connected to the upper body section on the top face; and the elevated cushioned cradle being positioned adjacent to the upper access hole opposite the lower access gap.

* * * * *